US005393630A

United States Patent [19]

Bayley et al.

[11] Patent Number: 5,393,630

[45] Date of Patent: Feb. 28, 1995

[54] MELT MIXING PROCESSES

[75] Inventors: Robert D. Bayley, Fairport; Carol A. Fox, Farmington; Thomas R. Hoffend, Webster, all of N.Y.; Hadi K. Mahabadi; Enno E. Agur, both of Toronto, Canada

[73] Assignee: Xerox Corporation, Stamford, Conn.

[21] Appl. No.: 131,250

[22] Filed: Oct. 4, 1993

[51] Int. Cl.[6] ..... G03G 9/087

[52] U.S. Cl. ..... 430/105; 430/137

[58] Field of Search ..... 427/18; 430/137, 106, 430/107, 105

[56] References Cited

U.S. PATENT DOCUMENTS 3,941,898 3/1976 Sadamatsu et al. ..... 427/18
4,089,917 5/1978 Takiura et al. ..... 264/40.3
4,513,074 4/1985 Nash et al. ..... 430/106.6
4,533,614 8/1985 Fukimoto et al. ..... 430/99
4,556,624 12/1985 Gruber et al. ..... 430/110
4,894,308 1/1990 Mahabadi et al. ..... 430/137
4,973,439 11/1990 Chang et al. ..... 264/101
5,227,460 7/1993 Mahabadi et al. ..... 528/272

*Primary Examiner*—John Goodrow
*Attorney, Agent, or Firm*—E. O. Palazzo

[57] ABSTRACT

A reactive melt mixing process for the preparation of a toner resin comprising the steps of (a) melt mixing a base resin with a matrix resin containing a crosslinking agent, thereby forming a polymer melt; and (b) crosslinking said polymer melt under high shear to form a crosslinked toner resin.

42 Claims, 1 Drawing Sheet

MELT MIXING PROCESSES

BACKGROUND OF THE INVENTION

The present invention is generally directed to toner compositions and processes for the preparation of toner resins and toner compositions. More specifically, the present invention relates to melt mixing processes, batch or continuous, and preferably continuous processes such as, for example, reactive extrusion for preparing crosslinked toner resins. The present invention relates to processes for crosslinking reactive linear resins which can be subsequently selected for the preparation of crosslinked toner resins that can be selected for application in heat fixable toners with superior fusing properties and excellent vinyl offset characteristics. In embodiments, the present invention relates to processes for crosslinking reactive linear resins wherein the chemical initiators selected for crosslinking are contained in a nonreactive or reactive polymer resin or a toner additive resin. Advantages associated with the present invention include the avoidance of hazards associated with the handling of dry powdered and liquid chemical initiators.

Toner utilized for development in the electrographic process is generally prepared by mixing and dispersing a colorant and a charge enhancing additive into a thermoplastic binder resin, followed by micropulverization. As the thermoplastic binder resin, several polymers are known, including polystyrenes, styrene-acrylic resins, styrene-methacrylic resins, polyesters, epoxy resins, acrylics, urethanes and copolymers thereof. As the colorant, carbon black can be utilized, and as the charge enhancing additive, alkyl pyridinium halides, distearyl dimethyl ammonium methyl sulfate, and the like are known.

To fix the toner to a support medium, such as a sheet of paper or transparency, hot roll fixing is commonly used. In this method, the support medium with a toner image is transported between a heated fuser roll and a pressure roll with the image face contacting the fuser roll. Upon contact with the heated fuser roll, the toner melts and adheres to the support medium forming a fixed image. This fixing system can be very advantageous in heat transfer efficiency and is especially suited for high speed electrophotographic processes.

Fixing performance of the toner can be characterized as a function of temperature. The lowest temperature at which the toner adheres to the support medium is referred to as the Cold Offset Temperature (COT), and the maximum temperature at which the toner does not adhere to the fuser roll is referred to as the Hot Offset Temperature (HOT). When the fuser temperature exceeds HOT, some of the molten toner adheres to the fuser roll during fixing and is transferred to subsequent substrates containing developed images resulting, for example, in blurred images. This undesirable phenomenon is known as offsetting. Between the COT and HOT of the toner is the Minimum Fix Temperature (MFT) which is the minimum temperature at which acceptable adhesion of the toner to the support medium occurs, as determined by, for example, a creasing test. The difference between MFT and HOT is referred to as the Fusing Latitude.

The known hot roll fixing system and a number of toners used therein can exhibit several problems. For example, the binder resins in the toners can require a relatively high temperature in order to be affixed to the support medium. This may result in high power consumption, low fixing speeds, and reduced life of the fuser roll and fuser roll bearings. Also, toner and image offsetting can be a problem. Moreover, toners containing vinyl type binder resins, such as styrene-acrylic resins, may have an additional problem which is known as vinyl offset. Vinyl offset occurs when a sheet of paper or transparency with a fixed toner image contacts for a period of time a polyvinyl chloride (PVC) surface containing a plasticizer, reference for example vinyl binder covers, and the fixed image adheres to the PVC surface.

There is a need for a toner resin with a fix temperature below 200° C. and preferably below about 160° C., that is a low fix temperature toner resin or a low melting toner resin, toner and toner resins with excellent offset properties and superior vinyl offset characteristics, and processes for the preparation thereof.

To prepare lower fix temperature resins for toner, the molecular weight of the resin may be lowered. Low molecular weight polymers such as amorphous polyester resins and epoxy resins have been used for low temperature fixing toners. For example, toners utilizing polyester resins as binders are illustrated in U.S. Pat. No. 3,590,000 and U.S. Pat. No. 3,681,106, the disclosures of which are hereby totally incorporated by reference herein. The minimum fixing temperature of polyester binder resins can be lower than that of other materials, such as styrene-acrylic and styrene-methacrylic resins. However, this may result in a lowering of the hot offset temperature and, as a result, decreased offset resistance. In addition, the glass transition temperature of the resin may be decreased, which may cause the undesirable phenomenon of toner blocking during storage.

To prevent fuser roll offsetting and to improve fusing latitude performance of toners, various modifications have been made to toner compositions. For example, waxes, such as low molecular weight polyethylene, polypropylene, and the like, can be added to toners to increase their release properties, reference U.S. Pat. No. 4,513,074, the disclosure of which is hereby totally incorporated by reference herein. However, to sufficiently prevent offset, considerable amounts of such materials may be required in some instances, resulting in detrimental effects such as the tendency for toner agglomeration, undesirable free flow properties and destabilization of toner charging properties.

Modification of the binder resin structure, for example by branching, crosslinking, and the like, when using conventional polymerization reactions may also improve offset resistance. For example, in U.S. Pat. No. 3,681,106 a process is disclosed whereby a polyester resin was improved with respect to offset resistance by nonlinearly modifying the polymer backbone by mixing a trivalent polyol or polyacid with the monomer to generate branching during polycondensation. However, an increase in degree of branching may result in an elevation of the minimum fix temperature. Thus, any initial advantage of low temperature fix may be diminished.

Another method of improving offset resistance is by crosslinking during polymerization. In U.S. Pat. No. 3,941,898, the entire disclosure of which is hereby totally incorporated by reference, there is illustrated, for example, a crosslinked vinyl type binder polymer prepared with conventional crosslinking. Similar disclosures for vinyl type resins are illustrated in U.S. Pat. Nos. Re. 31,072 (a reissue of U.S. Pat. No. 3,938,992); 4,556,624; 4,604,338, and 4,824,750 the disclosures of which are hereby totally incorporated herein by reference. Also, crosslinked polyester binder resins prepared by conventional polycondensation processes for improving offset resistance are illustrated in U.S. Pat. No. 3,681,106.

While improvements can be obtained in offset resistance and entanglement resistance, a major drawback may ensue with certain crosslinked resins prepared by conventional polymerization, both vinyl type processes including solution, bulk, suspension and emulsion polymerizations; and polycondensation processes. In these processes which operate typically between room temperature and 200° C., monomer and crosslinking agent are added to the reactor. The crosslinking reaction is not very rapid and chains can grow in more than two directions at the crosslinking point by the addition of monomers. Also, there are monomeric units between the crosslinked chains. Three types of polymer configurations are believed to result: a linear and soluble portion referred to as the linear portion, a crosslinked portion which is low in crosslinking density and, therefore, is soluble in some solvents, such as tetrahydrofuran, toluene and the like, and is referred to as the sol; and a portion comprising highly crosslinked gel particles which is not soluble in substantially any solvent, such as tetrahydrofuran, toluene and the like, and is referred to as the gel. The second portion with low crosslinking density (sol) functions primarily to widen the molecular weight distribution of the soluble part which results in an elevation of the minimum fixing temperature of the toner. The presence of monomeric units between the crosslinked chains enables gel swelling in the presence of solvents. Another disadvantage of these processes, which are effected under low shear, that is less than 0.1 kW-hr/kg), is that as more crosslinking agent is used the gel particles or very highly crosslinked insoluble polymer with high molecular weight increase in size. These large gels can be more difficult to disperse pigment in causing unpigmented toner particles during pulverization, and toner developability may thus be hindered. Also, with the formed resulting polymers, the toners thereof often evidence vinyl offset.

U.S. Pat. No. 4,533,614, the entire disclosure of which is hereby totally incorporated by reference herein, discloses a loosened crosslinked polyester binder resin which exhibits low temperature fix and some offset resistance. Metal compounds were used as crosslinking agents. Similar disclosures are presented in U.S. Pat. No. 3,681,106 and Japanese Laid-open Patent Applications 94362/1981, 116041/1981 and 166651/1980, the disclosures of which are hereby totally incorporated by reference herein. As indicated in the '614 patent, incorporation of metal complexes, however, can influence unfavorably the charging properties of the toner. Also, with color toners other than black, such as cyan, metal complexes can adversely affect the color of the pigments. It is also known that metal containing toner can have disposal problems in some areas, such as for example in the State of California, and metal complexes are often also costly.

U.S. Pat. No. 4,894,308 and U.S. Pat. No. 4,973,439, the disclosures of which are totally incorporated herein by reference, disclose, for example, extrusion processes for preparing electrophotographic toner compositions in which pigment and charge control additive were dispersed into a binder resin in the extruder. However, in each of these patents there is no suggestion, it is believed, of a chemical reaction occurring.

An injection molding process for producing crosslinked synthetic resin molded articles is disclosed in U.S. Pat. No. 3,876,736, the disclosure of which is totally incorporated herein by reference, in which polyolefin or polyvinyl chloride resin and crosslinking agent were mixed in an extruder, and then introduced into an externally heated reaction chamber outside the extruder wherein the crosslinking reaction occurred at increased temperature and pressure, and at low or zero shear.

In U.S. Pat. No. 4,089,917, the disclosure of which is totally incorporated herein by reference, an injection molding and crosslinking process is disclosed in which polyethylene resin and crosslinking agent were mixed in an extruder and reacted in reaction chambers at elevated temperature and pressure. Heating of the resin mixture occurred partially by high shear in inlet flow orifices. The crosslinking reaction in the reaction chambers was accomplished at low or zero shear, and the final product is a thermoset molded part, and thus, is not considered useful as a toner resin.

A process for dispensing premixed reactive precursor polymer mixtures through a die for the purposes of reaction injection molding or coating is described in U.S. Pat. No. 4,990,293, the disclosure of which is hereby totally incorporated herein by reference, in which polyurethane precursor systems were crosslinked in the die and not in the extruder. The dimensions of the die channel were determined such that the value of the wall shear stress was greater than a critical value to prevent gel buildup and consequent plugging of the die. The final product is a thermoset molded part, and thus, is not considered useful as a toner resin.

The processes disclosed in U.S. Pat. Nos. 3,876,736; 4,089,917 and 4,990,293 are not believed to be reactive extrusion processes since, for example, crosslinking occurs in a die or a mold, and not in an extruder. These processes are for producing engineering plastics such as thermoset materials which cannot be remelted once molded, and thus are not believed to be effectively suitable for toner applications.

In copending U.S. patent application Ser. No. 07/814,641 (D/91117) and U.S. Pat. No. 5,227,460 (D/91117Q), the disclosures of which are totally incorporated herein by reference, a process, toner resin composition, and toner composition are disclosed in which partially crosslinked thermoplastic binder resins for toners with low fix temperature, hot offset temperature related to the degree of crosslinking, and which exhibit minimal or substantially no vinyl offset are produced by reactive extrusion. In this process, a reactive resin, such as, for example, an unsaturated linear polyester resin, is crosslinked in the molten state under high temperature and high shear conditions using a chemical initiator such as, for example, certain organic peroxides, as a crosslinking agent in a batch or continuous melt mixing device such as, for example, an extruder. Processing of the aforementioned dry powdered chemical initiators in their virgin state can present hazards, such as, for example, nuisance dust and explosions in dry blending operations and in feeding to a melt mixing process. Injection of a liquid initiator to a melt mixing process also presents hazards, such as for example explosions. Further, if the virgin chemical initiator, dry powder or liquid is heated too quickly in the reactive extrusion process before being dispersed in the reactive resin, parallel reactions with crosslinking can occur resulting in the formation of undesirable byproducts. In addition, premature crosslinking can occur resulting in poor dispersion of the gel particles in the toner resin. These and other disadvantages are avoided or minimized with the present invention, especially when in embodiments there is selected a pelletized peroxide, available from Polyvel of New Jersey, and which peroxide can be effectively formulated into powders of various mesh sizes.

SUMMARY OF THE INVENTION

The present invention provides a safe reactive melt mixing process for generating low cost and safe crosslinked thermoplastic binder resins for toner with a low fix temperature and excellent desirable offset properties, and which toners evidence minimal or substantially no vinyl offset. In this process, in embodiments polymers are crosslinked in the molten state at high temperature and specific shear energy input of, for example, about 0.1 to about 0.5 kW-hr/kg, referred to as high shear, enabling substantially uniformly dispersed densely crosslinked microgels, substantially no sol and no monomeric units between crosslinked chains, preferably with chemical initiators contained in a matrix polymer resin, reactive or nonreactive, or a toner additive resin such as crosslinking agents in an extruder, preferably without utilizing monomer for crosslinking, and with minimal or no residual materials remaining in the resin after crosslinking.

The present invention provides a safe, economical, robust and reproducible process for preparing toner resins by batch or continuous process. In these processes, in embodiments crosslinking can be accomplished in less than 10 minutes and preferably equal to or less than about 5 minutes, and for example from about 1 to about 5 minutes, referred to as the short residence time or reaction time, to form microgel particles during melt mixing. High shear disperses the microgels substantially uniformly in the polymer melt and prevents the microgels from continuing to increase in size with increasing degree of crosslinking.

In the process of the present invention, in embodiments a crosslinkable linear resin referred to as the base resin, such as, for example, an unsaturated linear polyester resin, is crosslinked in the molten state under high temperature and high shear conditions, preferably using a chemical initiator, such as, for example, an organic peroxide, as a crosslinking agent wherein the chemical initiator is preferably contained in a matrix polymer resin, reactive or nonreactive; or a toner additive resin in a batch or continuous melt mixing device without forming any significant amounts of residual materials. The mixture of chemical initiator and nonreactive or reactive matrix polymer resin or toner additive resin can be referred to as a diluted initiator, and the nonreactive or reactive matrix resin or toner additive resin can be referred to as the matrix resin. Thus, the removal of byproducts or residual unreacted materials is avoided with process embodiments of the present invention. No monomers need be utilized in the process of the present invention, therefore, there is no need for removal of residual monomer and there is no or minimal monomer units between polymer chains resulting in densely crosslinked gel particles. In preferred embodiments of the process, the base resin and diluted initiator are preblended and fed upstream to a melt mixing device, such as an extruder, or the base resin and diluted initiator are fed separately to the melt mixing device, such as an extruder, at either upstream or downstream locations. The extruder screw configuration, length and temperature may be used which will enable the diluted initiator to be dispersed throughout the polymer melt before the onset of crosslinking, and further, which extruder provides a sufficient, but short, residence time for the crosslinking reaction to be accomplished. Temperature control enables the crosslinking reaction to be accomplished in a controlled and reproducible manner. Extruder screw configuration and length can also provide high shear conditions to distribute microgels, formed during the crosslinking reaction, throughout the polymer melt, and to retain the microgels from inordinately increasing in size with increasing degree of crosslinking. An optional devolatilization zone may be used to remove any volatiles. The polymer melt may then be pumped through a die to a pelletizer.

The processes of the present invention which can be utilized to generate a low cost, safe, crosslinked toner resin with substantially no unreacted or residual byproducts of crosslinking, and which can be sufficiently fixed at low temperature by hot roll fixing to afford energy savings, is particularly suitable as a toner for high speed fixing, that is higher than 10 pages per minute and preferably higher than 40, such as about 45 to about 75 pages per minute, and which toner possesses excellent offset performance and minimal or no vinyl offset.

Embodiments of the present invention include a reactive melt mixing process for the preparation of a toner resin comprising the steps of:

(a) melt mixing a base resin with a matrix resin containing a crosslinking agent, thereby forming a polymer melt; and (b) crosslinking said polymer melt under high shear to form a crosslinked toner resin.

DETAILED DESCRIPTION

Figure 1:
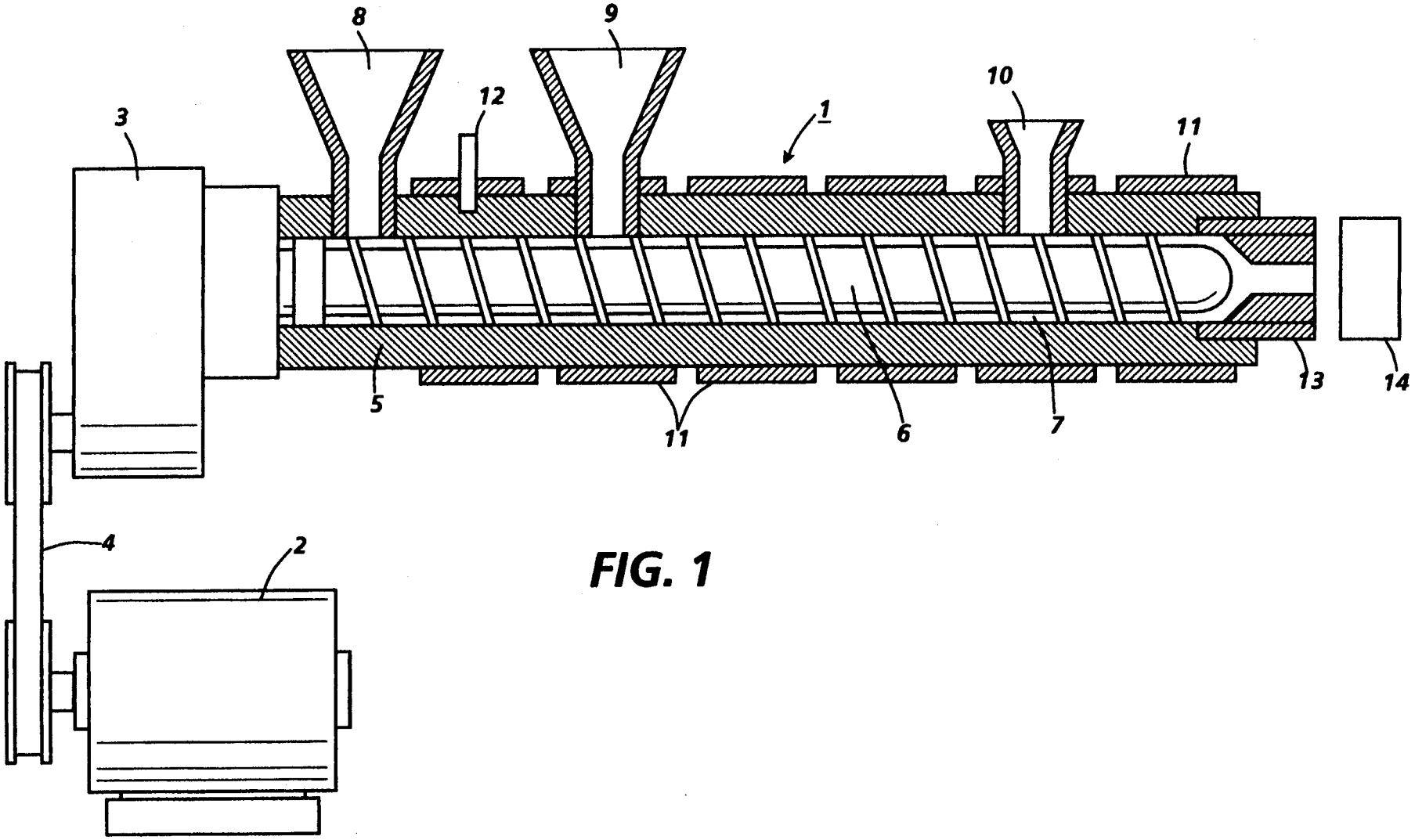
FIG. 1 is a partially schematic cross-sectional view of a reactive extrusion apparatus suitable for the process of the present invention.

The present invention provides a process for fabricating low fixing temperature toner resins and toners by reactive melt mixing in melt mixing devices, batch or continuous, but preferably continuous, such as, for example, an extruder wherein polymer base resins are crosslinked at high temperature and under high shear conditions, preferably using diluted chemical initiators as crosslinking agents, and without monomers. Crosslinked toner resins prepared by the process of the present invention can be comprised of linear portions and crosslinked portions. The linear portions are comprised of reactive and/or nonreactive resins and the crosslinked portions are comprised of highly crosslinked microgels or a highly crosslinked microgel.

Low fix temperature toner resins are fabricated in accordance with embodiments of the present invention by a reactive melt mixing process comprising the steps of (1) melting the base resin, thereby forming a polymer melt, in a melt mixing device; (2) initiating crosslinking of the polymer melt, preferably with a diluted chemical initiator and at increased reaction temperature; (3) retaining the polymer melt in the melt mixing devices for a sufficient residence time that partial crosslinking of the base resin may be achieved; (4) providing sufficiently high shear during the crosslinking reaction, thereby retaining gel particles formed during crosslinking small in size, for example submicron, that is below about 1 micron, like 0.5 micron, and well distributed in the polymer melt; and (5) optionally devolatilizing the melt to remove any effluent volatiles.

In one preferred embodiment, the initiator is contained in a nonreactive matrix resin, and the process comprises the steps of (1) feeding the base resin and a initiator, preferably a pelletized peroxide contained in the nonreactive matrix resin to an extruder; (2) melting the base resin and nonreactive matrix resin, thereby forming a polymer melt; (3) mixing the resulting molten base resin and initiator contained in the nonreactive matrix resin at low temperature to enable excellent dispersion of the initiator in the base resin prior to the onset of crosslinking; (4) initiating crosslinking of the base resin with initiator by increasing the melt temperature and controlling it along the extruder channel; (5) retaining the polymer melt in the extruder for a sufficient residence time at a given temperature such that the required amount of crosslinking is achieved; (6) providing sufficiently high shear during the crosslinking reaction thereby retaining the gel particles formed during crosslinking small in size and distributed throughout the polymer melt; (7) optionally devolatilizing the melt to remove any effluent volatiles; and (8) pumping the crosslinked resin melt through a die to a pelletizer.

In another embodiment, the initiator is contained in a toner additive resin and the process comprises the steps of (1) feeding the base resin and initiator contained in the toner additive resin to an extruder; (2) melting the base resin and toner additive resin, thereby forming a polymer melt; (3) mixing the molten base resin and initiator contained in the toner additive resin at low temperature to enable excellent dispersion of the initiator in the base resin prior to the onset of crosslinking; (4) initiating crosslinking of the base resin with the initiator by raising the melt temperature and controlling it along the extruder channel; (5) retaining the polymer melt in the extruder for a sufficient residence time at, for example, uneffective temperature such that the required effective amount of crosslinking is achieved; (6) providing sufficiently high shear during the crosslinking reaction thereby retaining the gel particles formed during crosslinking small in size and distributed throughout the polymer melt; (7) optionally devolatilizing the melt to remove any effluent volatiles; and (8) pumping the crosslinked resin melt through a die to a pelletizer.

In another embodiment, the initiator is contained in a reactive matrix resin which may or may not be similar to the base resin, and the process comprises the steps of (1) feeding the base resin and initiator contained in the reactive matrix resin to an extruder; (2) melting the base resin and reactive matrix resin, thereby forming a polymer melt; (3) mixing the resulting molten base resin and molten reactive matrix resin and initiator contained in the reactive matrix resin at a temperature lower than the onset of crosslinking to enable superior dispersion of the initiator in the base resin and matrix resin before the onset of crosslinking; (4) initiating crosslinking of the base resin and reactive matrix resin with the initiator by raising the melt temperature and controlling it along the extruder channel; (5) retaining the polymer melt in the extruder for a sufficient residence time such that the required amount of crosslinking is achieved; (6) providing sufficiently high shear during the crosslinking reaction thereby retaining the gel particles formed during crosslinking small in size, for example about 0.5 micron, and distributed throughout the polymer melt; (7) optionally devolatilizing the melt to remove any effluent volatiles; and (8) optionally pumping the crosslinked resin melt through a die to a pelletizer.

Several methods may be selected for incorporating the initiator into the matrix resin. In one method, a solution is prepared containing the matrix resin, the initiator and a solvent, such as for example, toluene, tetrahydrofuran, and the like. The solvent is then removed by drying, evaporation, or a solvent stripping step resulting in a mixture of the matrix resin and highly dispersed initiator. In an alternative approach, the initiator is dispersed into the matrix resin in a melt mixing device, such as for example an extruder at a temperature lower than the onset of crosslinking temperature. In both methods, the resulting matrix resin containing the dispersed initiator can be ground to a size suitable for dry blending with the base resin or for direct feeding to the extruder.

In the process of the present invention, the fabrication of the crosslinked resin may be accomplished in a melt mixing device such as an extruder described in U.S. Pat. No. 4,894,308, the disclosure of which is hereby totally incorporated herein by reference. Generally, any high shear, high temperature melt mixing device suitable for processing polymer melts may be employed. Examples of continuous melt mixing devices include single screw extruders or twin screw extruders, continuous internal mixers, gear extruders, disc extruders and roll mill extruders. Examples of batch internal melt mixing devices include Banbury mixers, Brabender mixers and Haake mixers.

One suitable type of extruder is the fully intermeshing corotating twin screw extruder such as, for example, the ZSK-30 twin screw extruder, available from Werner & Pfleiderer Corporation, Ramsey, N.J., U.S.A., which has a screw diameter of 30.7 millimeters and a length-to-diameter (L/D) ratio of 37.2. The extruder can melt the base resin, mix the diluted initiator into the base resin melt, provide high temperature and adequate residence time for the crosslinking reaction to be carried out, control the reaction temperature along the extruder channel, optionally devolatilize the melt to remove any effluent volatiles, and pump the crosslinked polymer melt through a die such as, for example, a strand die to a pelletizer. For chemical reactions in polymer melts, reactive extrusion is particularly efficient, and is advantageous since it utilizes no solvents, and thus is easily environmentally controlled. It is also advantageous because it permits a high degree of initial mixing of base resin and diluted initiator to take place, and provides an environment wherein a controlled high temperature, adjustable along the length of the extruder, is available so that a reaction can occur in less than 10 minutes and preferably from about 1 to about 5 minutes. The reaction can also be continuously, and thus the reaction is not limited by the disadvantages of a batch process, wherein the reaction must be repeatedly stopped so that the reaction products may be removed and the apparatus cleaned and prepared for another similar reaction. With the present invention, in embodiments when the desired amount of crosslinking is achieved, the reaction products can be removed immediately from the reaction chamber.

A typical reactive extrusion apparatus suitable for the process of the present invention is illustrated in FIG. 1. FIG. 1 illustrates a twin screw extrusion device 1 containing a drive motor 2, a gear reducer 3, a drive belt 4, an extruder barrel 5, a screw 6, a screw channel 7, an upstream supply port or hopper 8, a downstream supply port 9, a downstream devolatilizer 10, a heater 11, a thermocouple 12, a die or head pressure generator 13, and a pelletizer 14. The barrel 5 comprises modular barrel sections, each separately heated with heater 11 and temperature controlled by thermocouple 12. With modular barrel sections, it is possible to locate feed ports and devolatilizing ports at the required desired locations, and to provide segregated temperature control along the screw channel 7. The screw 6 is also modular, enabling the screw to be configured with modular screw elements and kneading elements having the appropriate lengths, and pitch angles in such a way as to provide optimum conveying, mixing, reaction, devolatilizing and pumping conditions.

In operation, the components to be reacted and extruded, for example the base resin and diluted chemical initiator, enter the extrusion apparatus from the first upstream supply port 8 and/or second downstream supply port 9. The base resin, usually in the form of solid pellets, chips, granules, or other forms can be fed to the first upstream supply port 8 and second downstream supply port 9 by starve feeding, gravity feeding, volumetric feeding, loss-in-weight feeding, or other known feeding methods. In one embodiment of the present invention, the base resin and the diluted initiator are preblended prior to being added to the extruder, and the preblend, the base resin and/or additional diluted initiator may be added through either upstream supply port 8, downstream supply port 9, or both. In another embodiment, the base resin and diluted initiator can preferably be added to the extruder separately through upstream supply port 8, downstream supply port 9, or both. After the base resin and diluted initiator have been fed into screw channel 7, the resin is melted and the initiator is dispersed into the molten resin as it is heated, but preferably still at a lower temperature than is need for crosslinking. Heating takes place from two sources: (1) external barrel heating from heaters 11, and (2) internal heating from viscous dissipation within the polymer melt itself. When the temperature of the molten resin and initiator reach a critical point, onset of the crosslinking reaction takes place. It is preferable, although not necessary, that the time required for completion of the crosslinking reaction not exceed the residence time in the screw channel 7. The rotational speed of the extruder screw preferably ranges from about 50 to about 500 revolutions per minute. Volatiles, if any, may be removed through downstream devolatilizer 10 by applying a vacuum. At the end of screw channel 7, the crosslinked resin is pumped in molten form through die 13, such as for example a strand die, to pelletizer 14, such as for example a water bath pelletizer, or an underwater granulator.

With further reference to FIG. 1, the rotational speed of the screw 6 can be of any suitable value provided that the objectives of the present invention are achieved. Generally, the rotational speed of screw 6 is from about 50 revolutions per minute to about 500 revolutions per minute. The barrel temperature, which is controlled by thermocouples 12 and generated in part by heaters 11, is from about 40° C. to about 250° C. The temperature range for mixing the base resin and diluted initiator in the upstream barrel zones is from about the melting temperature of the base resin to below the crosslinking onset temperature, and preferably within about 40° C. of the melting temperature of the base resin. For example, for an unsaturated polyester base resin the temperature is preferably about 90° C. to about 130° C. The temperature range for the crosslinking reaction in the downstream barrel zones is above the crosslinking onset temperature and the base resin melting temperature, preferably within about 150° C. of the base resin melting temperature. For example, for an unsaturated polyester base resin, the temperature is preferably about 90° C. to about 250° C. The die or head pressure generator 13 generates pressure from about 50 pounds per square inch to about 500 pounds per square inch. In one embodiment, the screw is allowed to rotate at about 100 revolutions per minute, the temperature along barrel 5 is maintained at about 70° C. in the first barrel section and 160° C. further downstream, and the die pressure is about 50 pounds per square inch.

When crosslinking, especially in a batch internal melt mixing device, the residence time is preferably in the range of about 10 seconds to about 5 minutes. The rotational speed of a rotor in the device is preferably about 10 to about 500 revolutions per minute.

Thus, in a process embodiment of this invention, a reactive base resin and a chemical initiator contained in a nonreactive or reactive matrix resin or toner additive resin are fed to a reactive melt mixing apparatus and crosslinking is accomplished at a high temperature and high shear to produce a crosslinked resin which enables the preparation of low fix temperature toners with excellent offset performance and vinyl offset properties.

The base resin can be a reactive polymer, preferably a linear reactive polymer such as, for example, a linear unsaturated polyester. In embodiments, the base resin, which can be selected in various effective amounts, such as from about 1 to about 95 weight percent, has a degree of unsaturation of about 0.1 to about 30 mole percent, and preferably about 5 to about 25 mole percent. In a preferred embodiment, the linear unsaturated polyester base resin is characterized by number average molecular weight ($M_n$) as measured by gel permeation chromatography (GPC) in the range of from about 1,000 to about 20,000, and preferably from about 2,000 to about 5,000, and a weight average molecular weight ($M_w$) in the range of from about 2,000 to about 40,000, and preferably from about 4,000 to about 15,000. The molecular weight distribution ($M_w/M_n$) is in the range of from about 1.5 to about 6, and preferably from about 2 to about 4. Onset glass transition temperature ($T_g$) as measured by differential scanning calorimetry (DSC) is in the range typically of from about 50° C. to about 70° C., and preferably from about 51° C. to about 60° C. Melt viscosity of the base resin as measured with a mechanical spectrometer at 10 radians per second is from about 5,000 to about 200,000 poise, and preferably from about 20,000 to about 100,000 poise, at 100° C. and drops or decreases sharply with increasing temperature to from about 100 to about 5,000 poise, and preferably from about 400 to about 2,000 poise, as the temperature increases from about 100° C. to about 130° C.

Linear unsaturated polyester examples selected as the base resin include low molecular weight condensation polymers which may be formed by the step-wise reactions between both saturated and unsaturated diacids, or anhydrides, and dihydric alcohols, glycols or diols, and the like. The resulting unsaturated polyesters are reactive, that is for example crosslinkable, on (i) unsaturation sites, double bonds, along the polyester chain, and (ii) functional groups such as carboxyl, hydroxy, and the like groups amenable to acid-base reactions. Typical unsaturated polyesters are prepared by melt polycondensation or other polymerization processes using diacids and/or anhydrides and diols. Suitable diacids and anhydrides include, but are not limited to, saturated diacids and/or anhydrides such as, for example, succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like, and mixtures thereof; and unsaturated diacids and/or anhydrides such as, for example, maleic acid, fumaric acid, chloromaleic acid, methacrylic acid, acrylic acid, itaconic acid, citraconic acid, mesaconic acid, maleic anhydride, and the like, and mixtures thereof. Suitable diols include but are not limited to, for example, alkyl glycols like propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like, and mixtures thereof, soluble in solvents such as, for example, tetrahydrofuran, toluene and the like.

Preferred linear unsaturated polyester base resins are prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. A particularly preferred unsaturated polyester is poly(propoxylated bisphenol A fumarate).

Substantially any suitable unsaturated polyester can be selected for the process of the present invention, including unsaturated polyesters known for use in toner resins and including unsaturated polyesters, the properties thereof which render them undesirable or unsuitable for use as toner resins, and the adverse undesirable properties thereof are eliminated or reduced by cross-linking them with the processes of the present invention.

The matrix resin selected in various effective amounts, such as for example from 1 to about 95 weight percent, containing the chemical initiator selected for the processes of this invention can be a nonreactive polymer, preferably a nonreactive polymer whose composition will not inversely affect the thermal, rheological, and therefore, fusing properties of the base toner resin. Preferably, there is selected a linear nonreactive polymer, such as a linear saturated polyester, and preferably a linear saturated polyester with similar molecular weight, thermal and rheological properties as the reactive base resin. In preferred embodiments, the linear saturated polyester matrix resin is characterized by number average molecular weight ($M_n$) as measured by gel permeation chromatography (GPC) in the range of from about 1,000 to about 20,000, and preferably from about 2,000 to about 5,000, and a weight average molecular weight ($M_w$) in the range of from about 2,000 to about 40,000, and preferably from about 4,000 to about 15,000. The molecular weight distribution ($M_w/M_n$) is in the range of from about 1.5 to about 6, and preferably from about 2 to about 4. Onset glass transition temperature (Tg) as measured by differential scanning calorimetry (DSC) is in the range of from about 50° C. to about 70° C., preferably from about 51° C. to about 60° C., and more preferably is equal to the glass transition temperature of the reactive base resin. Melt viscosity as measured with a mechanical spectrometer at 10 radians per second is from about 5,000 to about 200,000 poise, and preferably from about 20,000 to about 100,000 poise at 100° C., and decreases sharply with increasing temperature to from about 100 to about 5,000 poise, and preferably from about 400 to about 2,000 poise, as the temperature increases from about 100° C. to about 130° C.

Linear saturated polyesters selected as the matrix resin are in embodiments low molecular weight condensation polymers which may be formed by the step-wise reactions between saturated diacids, or anhydrides, and dihydric alcohols, including glycols or diols. Typical saturated polyesters are prepared by melt polycondensation or other polymerization processes using diacids and/or anhydrides and diols. Suitable diacids and anhydrides include but are not limited to saturated diacids and/or anhydrides such as, for example, succinic acid, glutaric acid, adipic acid, pimelic acid, suberic acid, azelaic acid, sebacic acid, isophthalic acid, terephthalic acid, hexachloroendomethylene tetrahydrophthalic acid, succinic anhydride, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like, and mixtures thereof. Suitable diols include, but are not limited to, for example propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like, and mixtures thereof, soluble in solvents such as, for example, tetrahydrofuran, toluene and the like.

Preferred linear saturated polyester matrix resins are prepared from diacids and/or anhydrides such as, for example, succinic acid, glutaric acid, and the like, and mixtures thereof; and diols such as, for example, propoxylated bisphenol A, propylene glycol, and the like, and mixtures thereof. A particularly preferred saturated polyester is poly(propoxylated bisphenol A succinate).

Alternatively, the matrix resin containing the chemical initiator selected for the process of the present invention can be a reactive polymer, the composition of which will not adversely affect the thermal, rheological, and therefore, fusing properties of the base toner resin. The linear reactive polymer can be a linear unsaturated polyester, and preferably is a linear unsaturated polyester with similar molecular weight, thermal and rheological properties as the reactive base resin. In preferred embodiments, the matrix resin has a degree of unsaturation of from about 0.1 to about 30 mole percent, and preferably from about 5 to about 25 mole percent, which in embodiments is similar to that of the reactive base resin. In preferred embodiments, the linear polyester matrix resin is characterized by a number average molecular weight ($M_n$) as measured by gel permeation chromatography (GPC) in the range of from about 1,000 to about 20,000, and preferably from about 2,000 to about 5,000, and a weight average molecular weight ($M_w$) in the range of from 2,000 to about 40,000, and preferably from about 4,000 to about 15,000. The molecular weight distribution ($M_w/M_n$) is in the range of from about 1.5 to about 6, and preferably from about 2 to about 4. Onset glass transition temperature (Tg) as measured by differential scanning calorimetry (DSC) is in the range of from 50° C. to about 70° C., preferably from about 51° C. to about 60° C., and more preferably is equal to the glass transition temperature of the reactive base resin. Melt viscosity as measured with a mechanical spectrometer at 10 radians per second is from about 5,000 to about 200,000 poise, and preferably from about 20,000 to about 100,000 poise, at 100° C. and drops or decreases sharply with increasing temperature to from about 100 to about 5,000 poise, and preferably from about 400 to about 2,000 poise, as the temperature increases to, for example, from about 100° C. to about 130° C.

Linear polyesters selected as the matrix resin can be low molecular weight condensation polymers which may be formed by the step-wise reactions between both saturated and unsaturated diacids, or anhydrides, and dihydric alcohols, such as glycols or diols. Typical unsaturated polyesters are prepared by melt polycondensation or other polymerization processes using diacids and/or anhydrides and diols. Suitable diacids and anhydrides include but are not limited to saturated diacids and/or anhydrides such as, for example, succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like, and mixtures thereof; and unsaturated diacids and/or anhydrides such as, for example, maleic acid, fumaric acid, chloromaleic acid, methacrylic acid, acrylic acid, itaconic acid, citraconic acid, mesaconic acid, maleic anhydride, and the like, and mixtures thereof. Suitable diols include but are not limited to propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like, and mixtures thereof, soluble in organic solvents such as, for example, tetrahydrofuran, toluene and the like.

Preferred linear polyester matrix resins are prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. One preferred polyester is poly(-propoxylated bisphenol A fumarate).

Alternatively, the matrix resin containing the chemical initiator selected for the process of this invention can be a toner additive resin utilized to modify the charging, fusing and other properties of the toner. Preferred toner additive resins include low molecular weight waxes, present in effective amounts, such as for example from about 0.1 to about 10 weight percent, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 7,000, and preferably about 5,000. Many of the polyethylene, polypropylene, and the like compositions useful in the present invention are illustrated in British Patent No. 1,442,835, the disclosure of which is totally incorporated herein by reference.

Various appropriate initiation methods for crosslinking can be selected for the processes of the present invention. Chemical initiators in effective amounts, such as from about 0.01 to about 20 weight percent, include, for example, organic peroxides or azo-compounds. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy) hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, o,o-t-butyl o-isopropyl mono peroxy carbonate, 2,5-dimethyl 2,5-di(benzoyl peroxy) hexane, o,o-t-butyl o-(2-ethyl hexyl) mono peroxy carbonate, and o,o-t-amyl o-(2-ethyl hexyl) mono peroxy carbonate, alkyl peroxides such as, for example, dicumyl peroxide, 2,5-dimethyl 2,5-di(t-butyl peroxy) hexane, t-butyl cumyl peroxide, $\alpha$-$\alpha$-bis(t-butyl peroxy) diisopropyl benzene, di-t-butyl peroxide and 2,5-dimethyl 2,5-di(t-butyl peroxy) hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy) valerate, 1,1-di(t-butyl peroxy) 3,3,5-trimethyl cyclohexane, 1,1-di(t-butyl peroxy) cyclohexane, 1,1-di(t-amyl peroxy) cyclohexane, 2,2-di(t-butyl peroxy) butane, ethyl 3,3-di(t-butyl peroxy) butyrate and ethyl 3,3-di(t-amyl peroxy) butyrate. Suitable azo compounds include azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), and the like. The initiator or crosslinkers are preferably obtained in a pelletized form, such as the peroxides available from Polyvel Inc. of Hammontown, N.J.; and these peroxides in the form of powders enable the generation of a uniform blend of peroxide and resin; and wherein the initiator can be incorporated into the toner resin without premature crosslinking.

In the crosslinking reaction which occurs in the process of the present invention at high temperature and high shear, and without the presence of monomers, the chemical initiator, such as for example benzoyl peroxide, disassociates to form free radicals which attack the linear unsaturated base resin polymer chains, for example, at double bonds to form polymeric radicals. Crosslinking occurs as these polymeric radicals react with other unsaturated chains or other polymeric radicals many times, forming very high molecular weight densely crosslinked gel particles.

The crosslinking which occurs in the process of the invention is characterized by at least one reactive site, that is one unsaturation, within a polymer chain reacting substantially directly, with no intervening monomer(s), with at least one reactive site within a second polymer chain to form a series of crosslinked units. This polymer crosslinking reaction may occur by a number of mechanisms. Without intending to be limited by theory, it is believed that the crosslinking may occur through one or more of the following mechanisms:

For example, when an exemplary propoxylated bisphenol A fumarate unsaturated polymer undergoes a crosslinking reaction with a chemical crosslinking initiator, such as, for example, benzoyl peroxide obtained in a pelletized form, free radicals produced by the chemical initiator may attack an unsaturation site on the polymer in the following manner

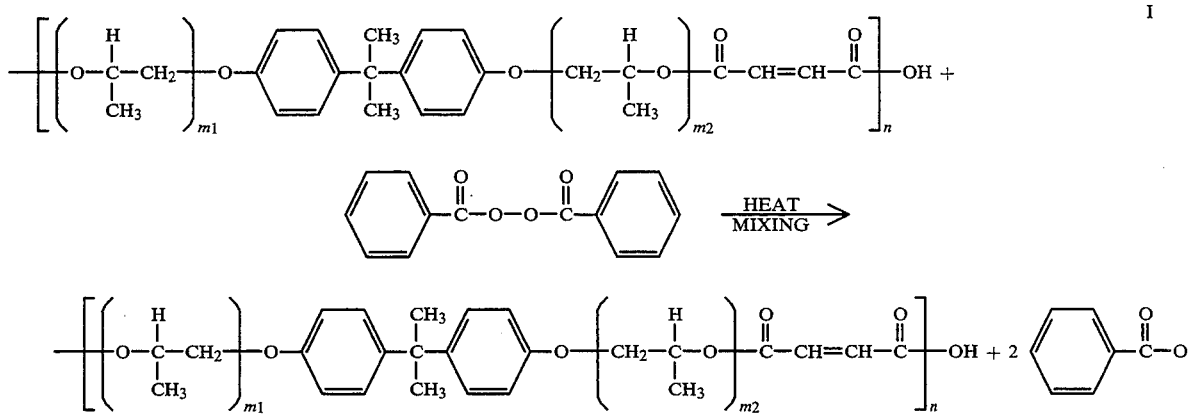

I

II

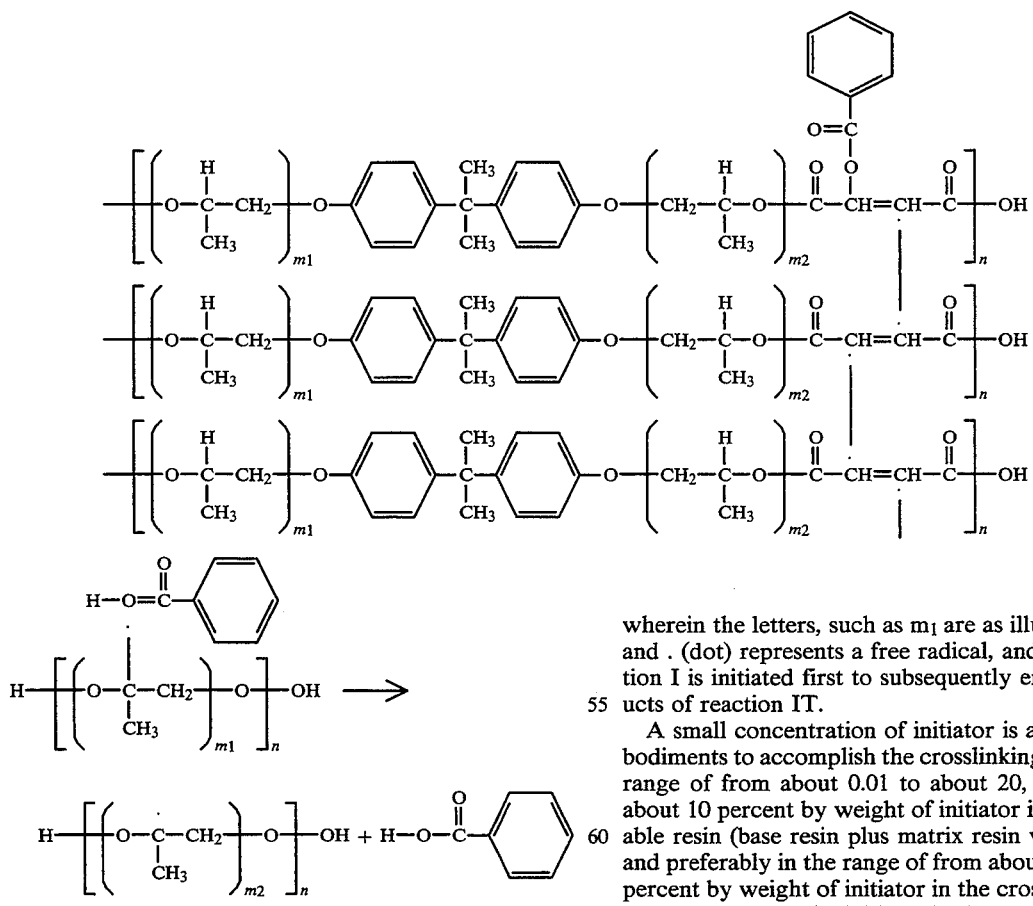

This manner of crosslinking between chains will produce a large, high molecular weight molecule, ultimately forming a gel, wherein $m_1$, $m_2$ and n represent the number of segments. In preferred embodiments of this exemplary polyester, $m_1$ and $m_2$ are at least 1 and the sum of $m_1$ and $m_2$ is not greater than 3. Specifically, $m_1$ and $m_2$ are independently from 1 to 3, and n is from about 8 to 11.

By a second mechanism, crosslinking may occur between chains of the same exemplary molecule where the free radicals formed from a chemical crosslinking initiator such as benzoic acid attack the carbon of the propoxy group by hydrogen abstraction of a tertiary hydrogen of a benzoyloxy radical in the following manner:

wherein the letters, such as $m_1$ are as illustrated herein, and . (dot) represents a free radical, and wherein reaction I is initiated first to subsequently enable the products of reaction IT.

A small concentration of initiator is adequate in embodiments to accomplish the crosslinking, usually in the range of from about 0.01 to about 20, and preferably about 10 percent by weight of initiator in the crosslinkable resin (base resin plus matrix resin when reactive), and preferably in the range of from about 0.1 to about 4 percent by weight of initiator in the crosslinkable resin. Concentration of the initiator in the matrix resin can be in the range from about 0.5 to about 80 percent by weight, and preferably from about 10 to about 20 percent by weight. Concentration of the matrix resin in the base resin can be in the range of from about 0.05 to about 10 percent by weight, and preferably from about 1 to about 5 percent by weight. By effecting the crosslinking in the melt state at high temperature and high shear in a melt mixing device, such as an extruder, the gel particles formed during crosslinking are kept small, that is submicron, for example, less than about 0.1 micron, and preferably from about 0.005 to about 0.1 micron, in average volume particle diameter as determined by scanning electron microscopy and transmission electron microscopy, and the size of the particle does not grow or very minimal growing is achieved with increasing degree of crosslinking. Also, the high shear enables the microgel particles to be substantially uniformly dispersed in the polymer melt.

An advantage of using a chemical initiator as the crosslinking agent is that by utilizing low concentrations of initiator, for example less than 10 percent by weight, in the crosslinkable resin and often less than 4 percent by weight, like, for example, about 3 percent by weight, and accomplishing the crosslinking at high temperature, little or no unreacted initiator remains in the product, and therefore, the residual contaminants produced in the crosslinking reaction are minimal. Further, with the initiator dispersed in a matrix resin, the likelihood of undesirable byproducts formed by primary radical termination or any other unwanted reaction is further reduced.

The crosslinked resin produced with the process of this invention in embodiments is a clean and nontoxic polymer mixture comprising in embodiments crosslinked gel particles and a noncrosslinked or linear portion but substantially no sol. The gel content of the crosslinked resin ranges from about 0.001 to about 50 percent by weight, and preferably from about 0.1 to about 40 percent by weight, wherein the gel content can be defined as follows:

$$\text{Gel Content } \frac{\text{Total Sample Weight} - \text{Weight of Soluble}}{\text{Total Sample Weight}} \times 100\%$$

There is substantially no crosslinked polymer which is not gel, that is, low crosslink density polymer or sol, as would be obtained in conventional crosslinking processes such as, for example, polycondensation, bulk, solution, suspension, emulsion and suspension polymerization processes.

The crosslinked portions of the crosslinked resin are comprised of very high molecular weight densely crosslinked microgel particles which are not soluble in substantially any solvents such as, for example, tetrahydrofuran, toluene, and the like. The microgel particles are highly crosslinked polymers with a short crosslink distance of zero or a maximum of one atom such as, for example, oxygen.

In a preferred embodiment in which the base resin and matrix resin have similar molecular weight, thermal and rheological properties, the linear portions of the crosslinked resin have substantially the same number average molecular weight ($M_n$), weight average molecular weight ($M_w$), molecular weight distribution ($M_w/M_n$), onset glass transition temperature (Tg), and melt viscosity as the base resin and matrix resin. Thus, in embodiments the entire crosslinked resin has an onset glass transition temperature of from about 50° C. to about 70° C., and preferably from about 51° C. to about 60° C., and a melt viscosity of from about 5,000 to about 200,000 poise, and preferably from about 20,000 to about 100,000 poise at 100° C., and from about 10 to about 80,000 poise at 160° C.

In embodiments, the toner resin prepared by the process of the present invention enables the preparation of toners with minimum fix temperatures in the range of about 100° C. to about 200° C., preferably about 100° C. to about 160° C., and more preferably about 110° C. to about 140° C. Also, these low fix temperature toners possess fusing latitudes ranging from about 10° C. to about 120° C., and preferably more than about 20° C., and more preferably more than about 30° C. The process of the present invention can generate toner resins and thus toners with minimal or substantially no vinyl offset.

Crosslinked polymers obtained with the present invention have the important rheological property of allowing a toner prepared therefrom to exhibit low fix temperature and excellent offset performance. The low fix temperature is a function of the molecular weight and molecular weight distribution of the linear portion, and is believed not to be significantly affected by the amount of microgel or degree of crosslinking in the resin. This is portrayed by the proximity of the viscosity curves at low temperature, such as for example at 100° C. for a crosslinked unsaturated polyester. The hot offset temperature is increased with the presence of microgel particles which impart elasticity to the resin. With higher degree of crosslinking or gel content, the hot offset temperature increases. This is reflected in divergence of the viscosity curves at high temperature such as, for example, at 160° C. As the degree of crosslinking or gel content increases, the low temperature melt viscosity does not change significantly while the high temperature melt viscosity increases. In embodiments, the hot offset temperature can increase approximately 70° C., which can be achieved by crosslinking in the melt state at high temperature and high shear such as, for example, in an extruder resulting in the formation of microgel alone, distributed substantially uniformly throughout the linear portion, and substantially no intermediates which are crosslinked polymers with low crosslinking density (sol). When crosslinked intermediate polymers are generated by conventional polymerization processes, the viscosity curves shift in parallel from low to high degree of crosslinking. This is reflected in increased hot offset temperature, and increased minimum fix temperature.

In addition to rendering a unique rheological property to the toner resin not attainable in conventional crosslinking processes for preparing toner resins, the reactive melt mixing process has several other important advantages in the context of the present invention. By selecting the type and molecular weight properties of the base resin, the minimum fix temperature can be manipulated. The hot offset temperature can be manipulated by the gel content in the crosslinked resin which can be controlled by the amount of initiator fed to the extruder and/or regulating the extruder process conditions such as, for example, feed rate, screw rotational speed, barrel temperature profile and screw configuration and length. Thus, with the present invention in embodiments there can be prepared a series of resins and thereof toners with the same or similar MFT, but with different fusing latitudes. Crosslinking by the use of diluted chemical initiators in the extruder is one of the cleanest means of modifying the resin, since very low concentrations of initiators are used, often less than 4 percent by weight, and the residual contaminants of the crosslinking reaction are minimal.

The toner resin is generally present in the toner in an amount of from about 40 to about 98 percent by weight, and more preferably from about 70 to about 98 percent by weight. For example, toner resin produced by the process of the invention can be subsequently melt blended or otherwise mixed with a colorant, charge carrier additives, surfactants, emulsifiers, pigment dispersants, flow additives, and the like. The resultant product can then be pulverized by known methods, such as milling, to form toner particles. The toner particles preferably have an average volume particle diameter of about 5 to about 25, and more preferably about 10 to about 20 microns.

Numerous well known suitable colorants can be selected for the toners of the invention in effective amounts of, for example, 1 to about 15 weight percent, including suitable colored pigments, dyes, and mixtures thereof including carbon black, such as REGAL 330® carbon black (Cabot Inc.), acetylene black, lamp black, aniline black, chrome yellow, zinc yellow, SICOFAST YELLOW TM, LUNA YELLOW TM, NOVAPERM YELLOW TM, Chrome Orange, Bayplast Orange, Cadmium Red, LITHOL SCARLET TM, HOSTAPERM RED TM, Fanal Pink, HOSTAPERM PINK TM, LITHOL RED TM, RHODAMINE LAKE B TM, Brilliant Carmine, HELIOGEN BLUE, HOSTAPERM BLUE, NEOPAN BLUE, PV FAST BLUE TM, Cinquassi Green, HOSTAPERM GREEN TM, titanium dioxide, cobalt, nickel, iron powder, SICOPUR 4068 FF TM, and iron oxides such as MAPICO BLACK TM (Columbia), NP608 TM and NP604 TM (Northern Pigment), BAYFERROX 8610 TM (Bayer), MO8699 TM (Mobay), TMB-100 TM (Magnox), mixtures thereof, and the like.

The colorant, preferably carbon black, red, blue, green, brown, cyan, magenta and/or yellow pigments and mixtures thereof, is present in an amount sufficient to render the toner composition with a sufficiently high color intensity. Generally, the pigment or dye is employed in an amount ranging from about 1 to about 20 percent by weight, and preferably from about 2 to about 10 percent based on the total weight of the toner composition; however, lesser or greater amounts of colorants can be selected.

When the colorants are comprised of magnetites or a mixture of magnetites and color pigment particles, thereby enabling single component toners and toners for magnetic ink character recognition (MICR) applications in some instances, which magnetites are a mixture of iron oxides ($FeO.Fe_2O_3$) including those commercially available as MAPICO BLACK TM, they are present in the toner composition in an amount of from about 5 weight percent to about 70 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK TM, in an amount of, for example, from about 5 to about 70, and preferably from about 10 to about 50 weight percent can be selected for black toner compositions of the present invention.

There can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K. K., and similar materials. The commercially available polyethylenes selected have a molecular weight of from about 1,000 to about 1,500, and the commercially available polypropylenes utilized for the toner compositions of the present invention are believed to have a molecular weight of from about 4,000 to about 5,000. Many of the polyethylene and polypropylene components are illustrated in British Patent 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Included within the scope of the present invention are toner and developer compositions comprised of a mixture of the aforementioned base and matrix toner resins or the toner resin product of the present invention, optional carrier particles, the charge enhancing additives illustrated herein, and as colorants red, blue, green, brown, magenta, cyan and/or yellow dyes or color pigments, as well as mixtures thereof. More specifically, with regard to the generation of color images utilizing a developer composition with known charge enhancing additives, illustrative examples of magenta materials that may be selected as colorants include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as colorants include copper phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In one embodiment, these colorants are present in the toner composition in an amount of from about 1 percent by weight to about 15 percent by weight based on the total weight of the toner.

Various known suitable effective positive or negative charge enhancing additives can be selected for the toner compositions of the present invention, preferably in an amount of about 0.1 to about 10, and more preferably about 1 to about 3 percent by weight. Examples include quaternary ammonium compounds inclusive of alkyl pyridinium halides reference U.S. Pat. No. 4,298,672, the disclosure of which is totally incorporated hereby by reference; organic sulfate and sulfonate compositions, U.S. Pat. No. 4,338,390, the disclosure of which is totally incorporated hereby by reference; cetyl pyridinium tetrafluoroborates; distearyl dimethyl ammonium methyl sulfate; bisulfates, such as distearyl dimethyl ammonium bisulfate; aluminum salts such as BONTRON E84 TM or E88v (Hodogaya Chemical); and the like.

There can also be blended with the toner compositions of the present invention external additives including flow aid additives, which additives are usually present on the surface thereof. Examples of these additives include colloidal silicas, such as AEROSIL ®, metal salts and metal salts of fatty acids inclusive of zinc stearate, metal oxides like aluminum oxides, cerium oxides, titanium oxides, and mixtures thereof, which additives are generally present in an amount of from about 0.1 percent by weight to about 5 percent by weight, and preferably in an amount of from about 0.5 percent by weight to about 2 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL ®, can be surface treated with the charge additives illustrated herein in an amount of from about 1 to about 50 weight percent and preferably about 10 weight percent to about 25 weight percent followed by the addition thereof to the toners in an amount of from 0.1 to 10 and preferably 0.1 to 5 weight percent.

Additionally, other internal and/or external additives may be added in known amounts for their known functions.

For the formulation of developer compositions, there are mixed with the toner particles carrier components, particularly those that are capable of triboelectrically assuming an opposite polarity to that of the toner composition. Accordingly, the carrier particles can be selected that would render the toner particles negatively charged while acquiring a positive charge polarity themselves via frictional charging against the toner particles. The opposite charge polarities of the carrier and toner particles of the developer composition thus ensure that the toner adhere to and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methyl methacrylate, and a silane, such as triethoxysilane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR ® and polymethylmethacrylate mixtures (40/60). Coating weights can vary as indicated herein; however, from about 0.3 to about 2, and preferably from about 0.5 to about 1.5 weight percent coating weight is selected in embodiments.

The diameter of the carrier particles, preferably spherical in shape, is generally from about 50 microns to about 1,000 microns, and preferably from between about 80 microns and about 200 microns in volume average diameter thereby permitting them, for example, to possess sufficient density and inertia to avoid adherence to the electrostatic images during the development process. The carrier component can be mixed with the toner composition in various suitable combinations, such as about 1 to 5 parts of toner to about 100 parts to about 200 parts by weight of carrier.

The toners of the present invention are usually jetted and classified subsequent to preparation to enable toner particles with a preferred volume average diameter of from about 5 to about 25 microns, and more preferably from about 5 to about 12 microns. The triboelectric charging rates for the toners of the present invention are preferably less than 120 seconds and more specifically less than 60 seconds in embodiments thereof as determined by the known charge spectrograph method as described hereinbefore. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

Toners produced by the process of the present invention can be used in known electrostatographic imaging and printing methods, and the fusing energy requirements for some of those methods can be reduced in view of the advantageous fusing properties of the toners of the present invention. Thus, for example, the toners or developers can be charged triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll at a temperature equal to or lower than 200° C., preferably lower than 160° C., more preferably lower than 140° C., and more preferably about 110° C.

In embodiments, the present invention relates to the selection of a diluted peroxide instead of, for example, a granular peroxide for the preparation of low melting toner resins by reactive extrusion methods, and wherein, for example, an initiator like a peroxide is mixed with an unsatured polyester prior to reactive extrusion enabling a substantially uniform peroxide resin mixture; and reactive extrusion processes wherein peroxide initiators are dispersed in nonreactive polyesters, which polyesters are similar to the unsaturated base resin like polyester base resin in melting temperature, glass transition temperature, Tg, molecular weight and the like, and wherein imcompatibility with the base resin is minimized or avoided. Preferably, the initiator is selected in a pellet form, or a very fine powder; or a mixture of peroxide dispersed in a polyolefin resin like polypropylene, 20 percent concentration of peroxide.

The invention will further be illustrated in the following nonlimiting Examples, it being understood that these Examples are intended to be illustrative only and that the invention is not intended to be limited to the materials, conditions, process parameters and the like recited herein. Parts and percentages are by weight unless otherwise indicated.

EXAMPLE I

A crosslinked unsaturated polyester resin is prepared by reacting 94 percent by weight of a linear bisphenol A fumarate polyester base resin having a $M_n$ of about 4,000, a $M_w$ of about 10,300, a $M_w/M_n$ of about 2.58 as measured by GPC, an onset Tg of about 55° C. as measured by DSC, and a melt viscosity of about 29,000 poise at 100° C., and about 750 poise at 130° C. as measured at 10 radians per second, and 6 percent by weight of a mixture of 10 percent by weight of benzoyl peroxide initiator and 90 percent by weight of a bisphenol A succinate polyester matrix resin with a $M_n$ of about 3,900, a $M_w$ of about 10,100, a $M_w/M_n$ of about 2.59 as measured by GPC, an onset Tg of about 55° C. as measured by DSC, and a melt viscosity of about 27,000 poise at 100° C., and about 740 poise at 130° C. as measured at 10 radians per second as outlined in the following procedure.

The unsaturated polyester resin and diluted benzoyl peroxide initiator are blended in a rotary tumble blender for 30 minutes. The resulting dry mixture is then fed into a Werner & Pfleiderer ZSK-30 twin screw extruder with a screw diameter of 30.7 millimeters and a length-to-diameter (L/D) ratio of 37.2 at 10 pounds per hour using a loss-in-weight feeder. Crosslinking is accomplished in the extruder with the following process conditions: barrel temperature profile of 70°/160°/160°/160°/160°/160°/160° C., die head temperature of 160° C., screw speed of 100 revolutions per minute and average residence time of about three minutes. The extrudate melt, upon exiting from the strand die, is cooled in a water bath and pelletized. The resulting product, which is a crosslinked polyester bisphenol A fumarate polyester containing about 5.4 percent by weight of bisphenol A succinate polyester, has an onset Tg of about 54° C. as measured by DSC, a melt viscosity of about 39,000 poise at 100° C., and about 140 poise at 160° C. as measured at 10 radians per second, a gel content of about 1.0 weight percent and a mean microgel particle size of about 0.1 micron as determined by transmission electron microscopy.

Thereafter, a toner is formulated by melt mixing the above prepared crosslinked unsaturated polyester resin, 92 percent by weight, with 6 percent by weight of REGAL 330® carbon black and 2 percent by weight of cetyl pyridinium chloride charge enhancing additive in a Haake batch mixer. The mixture is pulverized and classified to form a toner with an average particle diameter of about 8.9 microns and a geometric size distribution (GSD) of about 1.33. The toner is evaluated for fixing, blocking, and vinyl offset performance. Fusing evaluation of the toner evidences that the cold offset temperature is about 110° C., the minimum fix temperature is about 125° C., the hot offset temperature is about 135° C., and the fusing latitude is about 10° C. Also, the toner has excellent blocking performance, about 53° C. as measured by DSC, and evidences no apparent vinyl offset after testing.

EXAMPLE II

A crosslinked unsaturated polyester resin is prepared by a reactive extrusion process by melt mixing 90 parts, or 90 percent by weight, of a linear unsaturated polyester with the structure and properties of the polyester of Example I, and 10 percent by weight of a mixture of 10 percent by weight of benzoyl peroxide initiator and 90 percent by weight of the linear unsaturated polyester matrix base resin of Example I.

The unsaturated polyester resin and diluted benzoyl peroxide initiator are blended in a rotary tumble blender for 30 minutes. The resulting dry mixture is then fed into a Werner & Pfleiderer ZSK-30 twin screw extruder at 10 pounds per hour using a loss-in-weight feeder. The crosslinking is accomplished in the extruder with the following process conditions: barrel temperature profile of 70°/160°/160°/160°/160°/160°/160° C., die head temperature of 160° C., screw rotational speed of 100 revolutions per minute and average residence time of about three minutes. The extrudate melt, upon exiting from the strand die, is cooled in a water bath and pelletized. The product which is crosslinked bisphenol A fumarate polyester has an onset $T_g$ of about 54° C. as measured by DSC, a melt viscosity of about 52,000 poise at 100° C. and about 3,400 poise at 160° C. as measured at 10 radians per second, a gel content of about 19 weight percent and a mean microgel particle size of about 0.1 micron as determined by transmission electron microscopy.

Thereafter, a toner is prepared and evaluated according to the procedure of Example I except that the toner average particle diameter is about 9.5 microns and the GSD is about 1.31. Fusing evaluation of the toner evidences that the cold offset temperature is about 110° C., the minimum fix temperature is about 127° C., the hot offset temperature is about 160° C., and the fusing latitude is about 33° C. Also, the toner has excellent blocking performance (about 53° C. as measured by DSC) and evidences no apparent vinyl offset.

EXAMPLE III

The process of Example I is repeated except that the bisphenol A succinate polyester is replaced with a low molecular weight polyethylene wax as the matrix resin.

A crosslinked unsaturated polyester resin is prepared by the reactive extrusion process by melt mixing 88 percent by weight of a linear unsaturated polyester with the structure and properties of the resin of Example I, and 12 percent by weight of a mixture of 10 percent by weight of benzoyl peroxide initiator and 90 percent by weight of a low molecular weight, about 2,000 $M_w$, polyethylene wax.

The unsaturated polyester resin, wax and diluted benzoyl peroxide initiator are blended in a rotary tumble blender for 30 minutes. The resulting dry mixture is then fed into a Werner & Pfleiderer ZSK-30 twin screw extruder at 10 pounds per hour using a loss-in-weight feeder. The crosslinking is accomplished in the extruder with the following process conditions: barrel temperature profile of 70°/160°/160°/160°/160°/160°/160° C., die head temperature of 160° C., screw rotational speed of 100 revolutions per minute and average residence time of about three minutes. The extrudate melt, upon exiting from the strand die, is cooled in a water bath and pelletized. The product, which is crosslinked polyester, has an onset Tg of about 54° C. as measured by DSC, a melt viscosity of about 64,000 poise at 100° C. and about 14,000 poise at 160° C. as measured at 10 radians per second, a gel content of about 48 weight percent, and a mean microgel particle size of about 0.1 micron as determined by transmission electron microscopy.

Thereafter, a toner is prepared and evaluated according to the same procedure of Example I except that the toner average particle diameter is about 9.7 microns and the GSD is about 1.33. Fusing evaluation of the toner evidences that the cold offset temperature is about 110° C., the minimum fix temperature is about 128° C., the hot offset temperature is about 205° C., and the fusing latitude is about 77° C. Also, the toner has excellent blocking performance (about 53° C. as measured by DSC) and shows no apparent vinyl offset.

In embodiments, the present invention is directed to toner compositions comprised of pigment, known toner additives, and toner resins prepared as illustrated herein and comprised, for example, of an initiator, such as an organic peroxide, dispersed, preferably uniformly dispersed, in a nonreactive polyester resin, and a base resin, which base resin can be similar in Tg, molecular weight, melting temperature, and the like to the nonreactive polyester, and allows for excellent resin compatibility.

Other embodiments and modifications of the present invention may occur to those skilled in the art subsequent to a review of the information presented herein; these embodiments and modifications, as well as equivalents thereof, are also included within the scope of this invention.

What is claimed is:

1. A reactive melt mixing process for the preparation of a toner resin comprising:

(a) melt mixing a base resin with a matrix resin containing a crosslinking agent, thereby forming a polymer melt; and (b) crosslinking said polymer melt under high shear to form a crosslinked toner resin, and wherein said crosslinking agent is a chemical initiator.

2. The process of claim 1 wherein said melt mixing is a batch melt mixing process.

3. The process of claim 1 wherein said melt mixing is a continuous melt mixing process.

4. A process in accordance with claim 1 wherein the initiator is a peroxide.

5. The process of claim 1 wherein the step of mixing a matrix resin containing chemical initiator into said base resin is at a temperature lower than the onset of the crosslinking temperature, thereby enabling excellent dispersion of the chemical initiator in said polymer melt prior to onset of crosslinking of said polymer melt.

6. The process of claim 5 comprising the step of initiating crosslinking of said polymer melt with said chemical initiator by increasing the temperature of said polymer melt above the onset of the crosslinking temperature and controlling the temperature of said polymer melt during said crosslinking.

7. The process of claim 5 comprising the step of initiating crosslinking of said polymer melt with said chemical initiator by increasing the temperature of said polymer melt above the onset of crosslinking temperature and within 150° C. of the base resin melting temperature, and maintaining the temperature of said polymer melt during said crosslinking.

8. The process of claim 1 wherein the matrix resin is a noncrosslinkable polymer.

9. The process of claim 1 wherein said base resin is a linear unsaturated polyester resin, and said matrix resin is a saturated polyester resin.

10. The process of claim 9 wherein said linear unsaturated polyester base resin has a number average molecular weight ($M_n$) as measured by gel permeation chromatography (GPC) in the range of from about 1,000 to about 20,000, a weight average molecular weight ($M_w$) in the range of from about 2,000 to about 40,000, a molecular weight distribution ($M_w/M_n$) in the range of from about 1.5 to about 6, an onset glass transition temperature (Tg) as measured by differential scanning calorimetry in the range of from about 50° C. to about 70° C., and a melt viscosity as measured with a mechanical spectrometer at 10 radians per second of from about 5,000 to about 200,000 poise at 100° C., said melt viscosity optionally decreasing with increasing temperature to from about 100 to about 5,000 poise at 130° C.

11. The process of claim 9 wherein said linear unsaturated polyester base resin is prepared from (a) diacids or anhydrides selected from the group consisting of succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, maleic acid, fumaric acid, chloromaleic acid, methacrylic acid, acrylic acid, itaconic acid, citraconic acid, mesaconic acid, maleic anhydride, and mixtures thereof; and (b) diols selected from the group consisting of propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromobisphenol dipropoxy ether, 1,4-butanediol, and mixtures thereof.

12. The process of claim 9 wherein said saturated polyester matrix resin has substantially about the same molecular weight, glass transition temperature, Tg, and melt viscosity as said linear unsaturated polyester base resin; and wherein said saturated polyester number average molecular weight ($M_n$) as measured by gel permeation chromatography (GPC) is in the range of from about 1,000 to about 20,000, said weight average molecular weight ($M_w$) is in the range of from about 2,000 to about 40,000, and wherein the molecular weight distribution ($M_w/M_n$) is in the range of from about 1.5 to about 6, the onset glass transition temperature (Tg) as measured by differential scanning calorimetry is in the range of from 50° C. to about 70° C., and the melt viscosity as measured with a mechanical spectrometer at 10 radians per second is from about 5,000 to about 200,000 poise at 100° C., said melt viscosity decreasing with increasing temperature to from about 100 to about 5,000 poise at 130° C.

13. The process of claim 9 wherein said saturated polyester base resin is prepared from (a) diacids or anhydrides selected from the group consisting of succinic acid, glutaric acid, adipic acid, pimelic acid, suberic acid, azelaic acid, sebacic acid, isophthalic acid, terephthalic acid, hexachloroendomethylene tetrahydrophthalic acid, succinic anhydride, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and mixtures thereof; and (b) diols selected from the group consisting of propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromobisphenol dipropoxy ether, 1,4-butanediol, and mixtures thereof.

14. The process of claim 9 wherein said linear unsaturated polyester base resin is poly(propoxylated bisphenol A fumarate), and said saturated polyester matrix resin is poly(propoxylated bisphenol A succinate).

15. The process of claim 1 wherein said base resin is a linear unsaturated polyester resin, and said matrix resin is an unsaturated polyester resin.

16. The process of claim 15 wherein said linear unsaturated polyester matrix resin has substantially the same molecular weight, glass transition temperature, Tg, and melt viscosity as said linear unsaturated polyester base resin; and wherein said linear matrix polyester possesses a number average molecular weight ($M_n$) as measured by gel permeation chromatography (GPC) in the range of from about 1,000 to about 20,000, the weight average molecular weight ($M_w$) in the range of from about 2,000 to about 40,000, a molecular weight distribution ($M_w/M_n$) in the range of from about 1.5 to about 6, onset glass transition temperature (Tg) as measured by differential scanning calorimetry in the range of from 50° C. to about 70° C., and the melt viscosity as measured with a mechanical spectrometer at 10 radians per second of from about 5,000 to about 200,000 poise at 100° C.

17. The process of claim 15 wherein said unsaturated polyester base resin is prepared from (a) diacids or anhydrides selected from the group consisting of succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, maleic acid, fumaric acid, chloromaleic acid, methacrylic acid, acrylic acid, itaconic acid, citraconic acid, mesaconic acid, maleic anhydride, and mixtures thereof; and (b) diols selected from the group consisting of propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromobisphenol dipropoxy ether, 1,4-butanediol, and mixtures thereof.

18. The process of claim 15 wherein said linear unsaturated polyester base resin and said linear unsaturated polyester matrix resin are poly(propoxylated bisphenol A fumarate).

19. The process of claim 1 wherein said matrix resin is a wax.

20. The process of claim 19 wherein said wax is polypropylene, or polyethylene with a molecular weight ($M_w$) of from about 1,000 to about 20,000.

21. The process of claim 19 wherein said matrix resin is the linear unsaturated polyester base resin poly(propoxylated bisphenol A fumarate), and said wax is polypropylene with a molecular weight of about 7,000.

22. The process of claim 1 wherein said crosslinking is initiated by a chemical initiator selected from the group consisting of organic peroxides and azo compounds.

23. The process of claim 22 wherein the weight percent fraction of said chemical initiator in said matrix resin is from about 0.5 to about 80 weight percent.

24. The process of claim 22 wherein the weight percent fraction of said matrix resin in said base resin is from about 0.05 to about 10 weight percent.

25. The process of claim 1 wherein said melt mixing process is accomplished in an extruder.

26. The process of claim 1 comprising first mixing said base resin and said matrix resin to form a preblend, and feeding said preblend, additional base resin, and additional matrix resin containing chemical initiator to a continuous melt mixing apparatus.

27. The process of claim 1 further comprising the step of forming solid toner particles from said crosslinked toner resin.

28. The process of claim 27 further comprising the step of combining carrier particles with said toner particles to form a developer.

29. The process of claim 1 wherein said toner resin is combined with at least one member selected from the group consisting of a colorant and a charge control additive to form a mixture, and said mixture is further melt blended to form a toner.

30. The process of claim 29 wherein said colorant is selected from the group consisting of carbon black, cyan, magenta, yellow and mixtures thereof.

31. The process of claim 29 wherein said charge control additive is selected from the group consisting of alkyl pyridinium halides and distearyl dimethyl ammonium methyl sulfate.

32. A process in accordance with claim 4 wherein the peroxide is comprised of pellets subsequently formed into a powder.

33. The process of claim 1 wherein said toner resin obtained is a polyester resin comprising crosslinked portions and linear portions; wherein said crosslinked portions comprise very high molecular weight gel particles with high density crosslinking; wherein said gel particles are submicron in diameter and are substantially uniformly distributed in said resin; and wherein said linear portions are a mixture of linear unsaturated polyester and saturated polyester having a number average molecular weight ($M_n$) as measured by gel permeation chromatography in the range of from about 1,000 to about 20,000, a weight average molecular weight ($M_w$) of from about 2,000 to about 40,000, a molecular weight distribution ($M_w/M_n$) of from about 1.5 to about 6, an onset glass transition temperature (Tg) as measured by differential scanning calorimetry in the range of from about 50° C. to about 70° C., and a melt viscosity as measured with a mechanical spectrometer at 10 radians per second of from about 5,000 to about 200,000 poise at 100° C.

34. The process of claim 1 wherein the toner resin obtained is a polyester resin comprising crosslinked portions and linear portions; wherein said crosslinked portions are in the form of microgels less than 0.1 micron in average volume particle diameter and are substantially uniformly distributed in said resin; wherein the amount of crosslinked portions or gel content is in the range from about 0.001 to about 50 percent by weight of said toner resin; wherein the amount of linear portions is in the range of about 50 to about 99.999 percent by weight of said toner resin; and wherein said resin has an onset glass transition temperature in the range of from about 50° C. to about 70° C., and a melt viscosity at 10 radians per second from about 5,000 to about 200,000 poise at 100° C. and from about 10 to about 20,000 poise at 160° C.

35. A process of claim 34 wherein said toner resin provides a toner with a minimum fix temperature of from about 100° C. to about 160° C., a hot offset temperature of from about 110° C. to about 250° C., and substantially no vinyl offset.

36. A toner comprised of the resin of claim 1, and pigment.

37. A toner in accordance with claim 35 further including toner additives.

38. A toner in accordance with claim 36 wherein said additives are charge control components.

39. A developer comprised of the toner of claim 36, and carrier.

40. A reactive melt mixing process for the preparation of a toner resin consisting essentially of:

(a) melt mixing a base resin with a matrix resin containing a crosslinking agent, thereby forming a polymer melt; and (b) crosslinking said polymer melt under high shear to form a crosslinked toner resin, and wherein said crosslinking agent is a chemical initiator.

41. A process in accordance with claim 1 wherein said high shear is accomplished at from about 50 to about 500 revolutions per minute.

42. A process in accordance with claim 11 wherein said high shear is accomplished at from about 50 to about 500 revolutions per minute.

* * * * *